US011221568B2

(12) United States Patent
Williamson et al.

(10) Patent No.: US 11,221,568 B2
(45) **Date of Patent: *Jan. 11, 2022**

(54) TONER CONTAINER HAVING A COMMON INPUT GEAR FOR A TONER AGITATOR ASSEMBLY AND AN ENCODED MEMBER

(71) Applicant: LEXMARK INTERNATIONAL, INC., Lexington, KY (US)

(72) Inventors: Randal Scott Williamson, Georgetown, KY (US); Virgil Johnson, Jr., Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/087,944

(22) Filed: Nov. 3, 2020

(65) Prior Publication Data

US 2021/0048765 A1 Feb. 18, 2021

Related U.S. Application Data

(63) Continuation of application No. 16/690,203, filed on Nov. 21, 2019, now Pat. No. 10,859,944, which is a continuation of application No. 16/157,495, filed on Oct. 11, 2018, now Pat. No. 10,527,967.

(51) Int. Cl.
*G03G 15/08* (2006.01)
*G03G 21/18* (2006.01)

(52) U.S. Cl.
CPC ..... *G03G 15/0867* (2013.01); *G03G 15/0889* (2013.01); *G03G 15/0891* (2013.01); *G03G 21/1896* (2013.01); *G03G 2215/0675* (2013.01)

(58) Field of Classification Search
CPC ..... G03G 15/0889; G03G 15/0863; G03G 15/0867; G03G 15/0891; G03G 21/1875; G03G 21/1896
See application file for complete search history.

(56) References Cited

U.S. PATENT DOCUMENTS 5,995,772 A * 11/1999 Barry ..... G03G 15/0889 399/12
6,397,015 B2 * 5/2002 Curry ..... G03G 21/1896 235/461

(Continued)

*Primary Examiner* — Sandra Brase
(74) *Attorney, Agent, or Firm* — Justin M. Tromp

(57) ABSTRACT

A toner container includes a housing having a toner reservoir. An input gear is positioned on the housing for mating with a corresponding output gear in an image forming device when the toner container is installed in the image forming device. A toner agitator is movably positioned in the reservoir. The toner agitator is operatively connected to the input gear such that rotation of the input gear in a first rotational direction causes movement of the toner agitator for agitating toner in the reservoir. An encoded member is encoded with authentication information of the toner container and is operatively connected to the input gear such that rotation of the input gear in a second rotational direction causes movement of the encoded member for communicating the authentication information of the toner container to a controller of the image forming device when the toner container is installed in the image forming device.

11 Claims, 15 Drawing Sheets

(56) References Cited

U.S. PATENT DOCUMENTS

| | | | | |
|---|---|---|---|---|
| 8,867,966 | B2 * | 10/2014 | Acosta | G03G 15/0867 399/258 |
| 10,527,967 | B1 * | 1/2020 | Williamson | G03G 21/1896 |
| 10,527,969 | B1 * | 1/2020 | Williamson | G03G 15/0867 |
| 10,859,944 | B2 * | 12/2020 | Williamson | G03G 21/1896 |
| 2005/0163530 | A1 * | 7/2005 | Miller | G03G 21/1896 399/113 |
| 2016/0238981 | A1 * | 8/2016 | Suido | F16D 1/076 |

* cited by examiner

TONER CONTAINER HAVING A COMMON INPUT GEAR FOR A TONER AGITATOR ASSEMBLY AND AN ENCODED MEMBER

CROSS REFERENCES TO RELATED APPLICATIONS

This application is a continuation application of U.S. patent application Ser. No. 16/690,203, filed Nov. 21, 2019, entitled "Toner Container Having a Common Input Gear for a Toner Agitator Assembly and an Encoded Member," which is a continuation application of U.S. patent application Ser. No. 16/157,495, filed Oct. 11, 2018, now U.S. Pat. No. 10,527,967, issued Jan. 7, 2020, entitled "Toner Container Having a Common Input Gear for a Toner Agitator Assembly and an Encoded Member."

BACKGROUND

1. Field of the Disclosure

The present disclosure relates generally to image forming devices and more particularly to a toner container having a common input gear for a toner agitator assembly and an encoded member.

2. Description of the Related Art

In electrophotographic image forming devices, one or more replaceable toner containers may be used to supply toner for printing onto sheets of media. Each toner container often includes a toner agitator assembly that agitates and mixes toner stored in a toner reservoir to prevent the toner from clumping and that moves the toner to an outlet of the toner container. It is often desired for each toner container to communicate characteristics of the toner container to the image forming device for proper operation. For example, it may be desired to communicate such information as authentication or validation information, toner fill amount, toner color, toner type, etc.

SUMMARY

A toner container for use in an electrophotographic image forming device according to one example embodiment includes a housing having a reservoir for storing toner. An input gear is positioned on the housing for mating with a corresponding output gear in the image forming device when the toner container is installed in the image forming device. A toner agitator is movably positioned in the reservoir. The toner agitator is operatively connected to the input gear such that rotation of the input gear in a first rotational direction causes movement of the toner agitator for agitating toner in the reservoir. An encoded member is encoded with authentication information of the toner container and is operatively connected to the input gear such that rotation of the input gear in a second rotational direction causes movement of the encoded member for communicating the authentication information of the toner container to a controller of the image forming device when the toner container is installed in the image forming device.

In some embodiments, the toner container includes a one-way clutch positioned to decouple the toner agitator from the input gear when the input gear rotates in the second rotational direction such that the toner agitator does not move with the input gear when the input gear rotates in the second rotational direction.

In some embodiments, the toner agitator includes a shaft rotatably positioned in the reservoir and a plurality of extensions outward from the shaft for agitating toner in the reservoir. In some embodiments, the toner agitator includes a rotatable auger positioned to move toner to an outlet port on the housing for exiting toner from the toner container.

Embodiments include those wherein the encoded member is rotatably connected to the input gear such that rotation of the input gear in the second rotational direction causes rotation of the encoded member. In some embodiments, the encoded member is positioned on an axial face of the input gear. In some embodiments, the encoded member is coaxial with the input gear.

In some embodiments, the encoded member is directly connected to the input gear. In other embodiments, the encoded member is indirectly connected to the input gear.

Embodiments include those wherein the encoded member is encoded with authentication information of the toner container by a random distribution of magnetized particles dispersed on the encoded member.

A toner container for use in an electrophotographic image forming device according to another example embodiment includes a housing having a reservoir for storing toner. An input gear is positioned on the housing for mating with a corresponding output gear in the image forming device when the toner container is installed in the image forming device. A toner agitator is movably positioned in the reservoir. The toner agitator is operatively connected to the input gear such that rotation of the input gear in a first rotational direction causes movement of the toner agitator for agitating toner in the reservoir. An encoded member is encoded with identifying information of the toner container and is operatively connected to the input gear such that rotation of the input gear in a second rotational direction causes movement of the encoded member for communicating the identifying information of the toner container to a sensor of the image forming device when the toner container is installed in the image forming device. A one-way clutch is positioned to decouple the toner agitator from the input gear when the input gear rotates in the second rotational direction such that the toner agitator does not move with the input gear when the input gear rotates in the second rotational direction.

A toner container for use in an electrophotographic image forming device according to another example embodiment includes a housing having a reservoir for storing toner. An input gear is positioned on the housing for mating with a corresponding output gear in the image forming device when the toner container is installed in the image forming device. A toner agitator is rotatably positioned in the reservoir. The toner agitator is operatively connected to the input gear such that rotation of the input gear in a first rotational direction causes rotation of the toner agitator in an operative rotational direction of the toner agitator for agitating toner in the reservoir. An encoded member is encoded with information pertaining to the toner container and is operatively connected to the input gear such that rotation of the input gear in a second rotational direction causes movement of the encoded member for reading of the information pertaining to the toner container by a sensor when the toner container is installed in the image forming device. A one-way clutch is configured to limit rotation of the toner agitator with the input gear to the operative rotational direction of the toner agitator.

A toner container for use in an electrophotographic image forming device according to another example embodiment includes a housing having a reservoir for storing toner. An input gear is positioned on the housing for mating with a corresponding output gear in the image forming device when the toner container is installed in the image forming device. An outlet port is positioned on the housing and is in fluid communication with the reservoir for exiting toner from the toner container. An auger is positioned within the housing and is operatively connected to the input gear such that rotation of the input gear in a first rotational direction causes rotation of the auger in an operative rotational direction of the auger. The auger is positioned to move toner to the outlet port when the auger rotates in the operative rotational direction of the auger. A toner agitator is positioned in the reservoir that includes a rotatable drive shaft. The toner agitator is operatively connected to the input gear such that rotation of the input gear in the first rotational direction causes rotation of the drive shaft in an operative rotational direction of the toner agitator for agitating toner in the reservoir. An encoded member is encoded with identifying information of the toner container and is operatively connected to the input gear such that rotation of the input gear in a second rotational direction causes movement of the encoded member for communicating the identifying information of the toner container to a sensor of the image forming device when the toner container is installed in the image forming device. A one-way clutch is positioned to decouple the auger and the toner agitator from the input gear when the input gear rotates in the second rotational direction such that the auger and the drive shaft do not rotate with the input gear when the input gear rotates in the second rotational direction.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
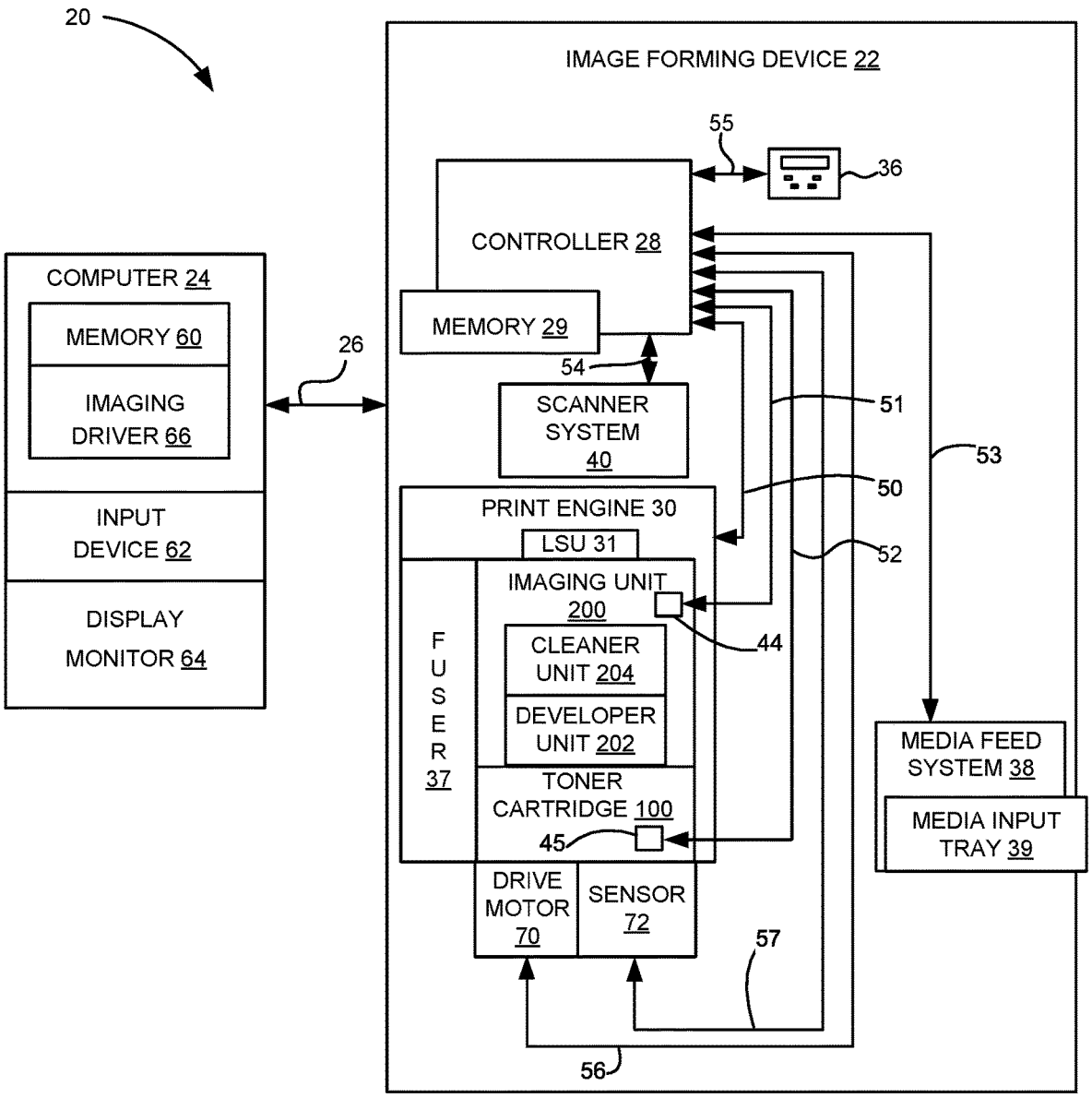
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39, a scanner system 40, a drive motor 70 and a sensor 72. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more application-specific integrated circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Controller 28 communicates with drive motor 70 via a communications link 56. Controller 28 communicates with sensor 72 via a communications link 57. Controller 28 processes print and scan data and operates print engine 30 during printing and scanner system 40 during scanning. Processing circuitry 44, 45 may provide authentication functions, safety and operational interlocks, operating parameters and usage information related to imaging unit 200 and toner cartridge 100, respectively. Each of processing circuitry 44, 45 includes a processor unit and associated electronic memory. As discussed above, the processor may include one or more integrated circuits in the form of a microprocessor or central processing unit and may include one or more application-specific integrated circuits (ASICs). The memory may be any volatile or non-volatile memory or combination thereof or any memory device convenient for use with processing circuitry 44, 45.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and a fuser 37, all mounted within image forming device 22. Imaging unit 200 is removably mounted in image forming device 22 and includes a developer unit 202 that houses a toner sump and a toner development system. In one embodiment, the toner development system utilizes what is commonly referred to as a single component development system. In this embodiment, the toner development system includes a toner adder roll that provides toner from the toner sump to a developer roll. A doctor blade provides a metered uniform layer of toner on the surface of the developer roll. In another embodiment, the toner development system utilizes what is commonly referred to as a dual component development system. In this embodiment, toner in the toner sump of developer unit 202 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 202 includes a magnetic roll that attracts the magnetic carrier beads having toner thereon to the magnetic roll through the use of magnetic fields. Imaging unit 200 also includes a cleaner unit 204 that houses a photoconductive drum and a waste toner removal system.

Toner cartridge 100 is removably mounted in imaging forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner sump in developer unit 202.

The electrophotographic printing process is well known in the art and, therefore, is described briefly herein. During a printing operation, laser scan unit 31 creates a latent image on the photoconductive drum in cleaner unit 204. Toner is transferred from the toner sump in developer unit 202 to the latent image on the photoconductive drum by the developer roll (in the case of a single component development system) or by the magnetic roll (in the case of a dual component development system) to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
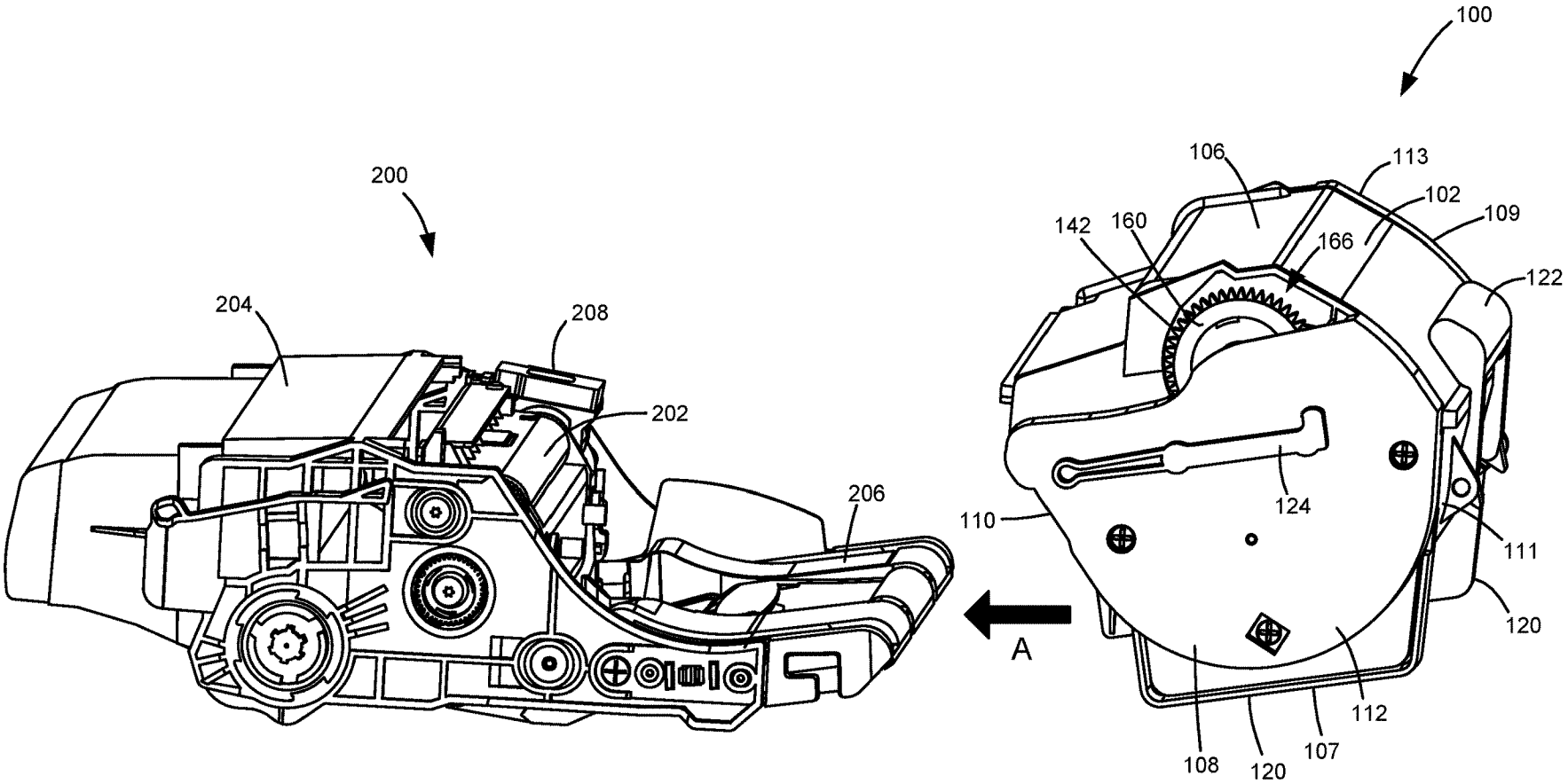
FIG. 2 is a perspective view of a toner cartridge and an imaging unit according to one example embodiment.

Referring now to FIG. 2, toner cartridge 100 and imaging unit 200 are shown according to one example embodiment. Imaging unit 200 includes a developer unit 202 and a cleaner unit 204 mounted on a common frame 206. Developer unit 202 includes a toner inlet port 208 positioned to receive toner from toner cartridge 100. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto frame 206 in a mating relationship with developer unit 202 of imaging unit 200 as indicated by the arrow A shown in FIG. 2, which also indicates the direction of insertion of imaging unit 200 and toner cartridge 100 into image forming device 22. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, cleaner unit 204 or frame 206 or to clear a media jam.

With reference to FIGS. 2-5, toner cartridge 100 includes a housing 102 having an enclosed reservoir 104 (FIG. 5) for storing toner. Housing 102 includes a top 106, a bottom 107, first and second sides 108, 109, a front 110 and a rear 111. Front 110 of housing 102 leads during insertion of toner cartridge 100 into image forming device 22 and rear 111 trails. In one embodiment, each side 108, 109 of housing 102 includes an end cap 112, 113 mounted, e.g., by fasteners or a snap-fit engagement, to side walls 114, 115 of a main body 116 of housing 102. An outlet port 118 in fluid communication with reservoir 104 is positioned on front 110 of housing 102 near side 109 for exiting toner from toner cartridge 100. Housing 102 may include legs 120 on bottom 107 to assist with the insertion of toner cartridge 100 into image forming device 22 and to support housing 102 when toner cartridge 100 is set on a flat surface. A handle 122 may be provided on top 106 or rear 111 of housing 102 to assist with insertion and removal of toner cartridge 100 into and out of image forming device 22.

Figure 3:
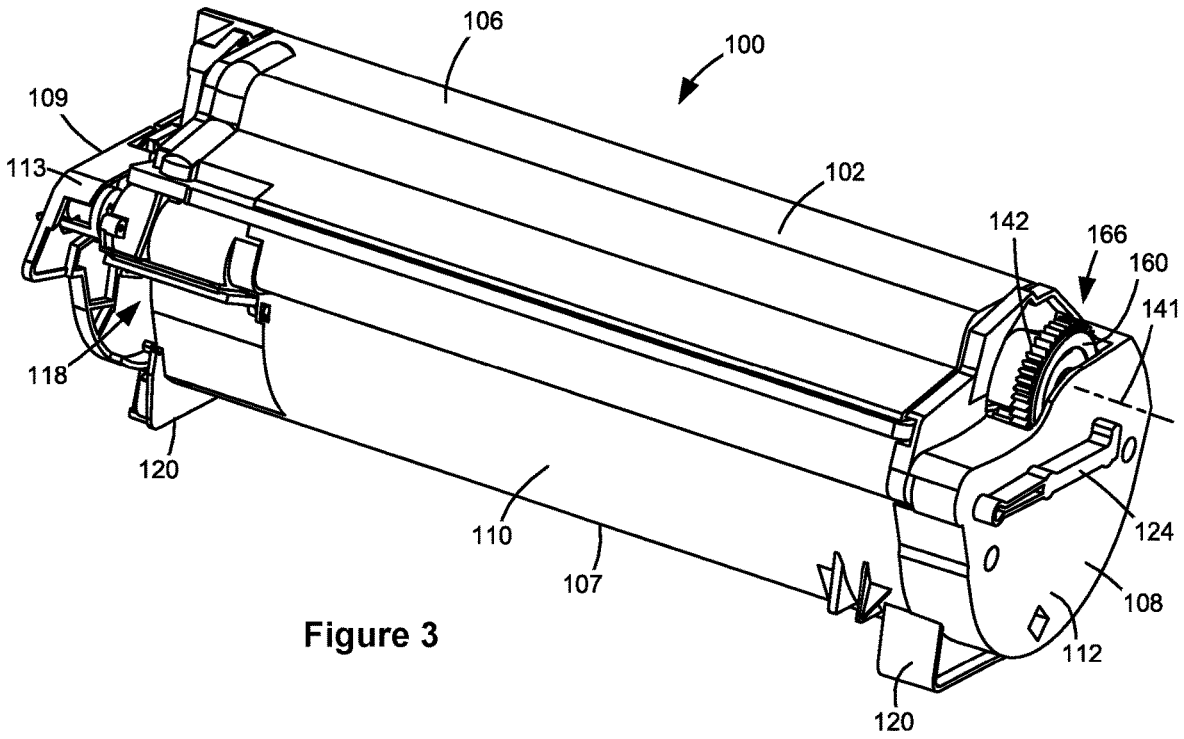
FIG. 3 is a front perspective view of the toner cartridge shown in FIG. 2.
Figure 4:
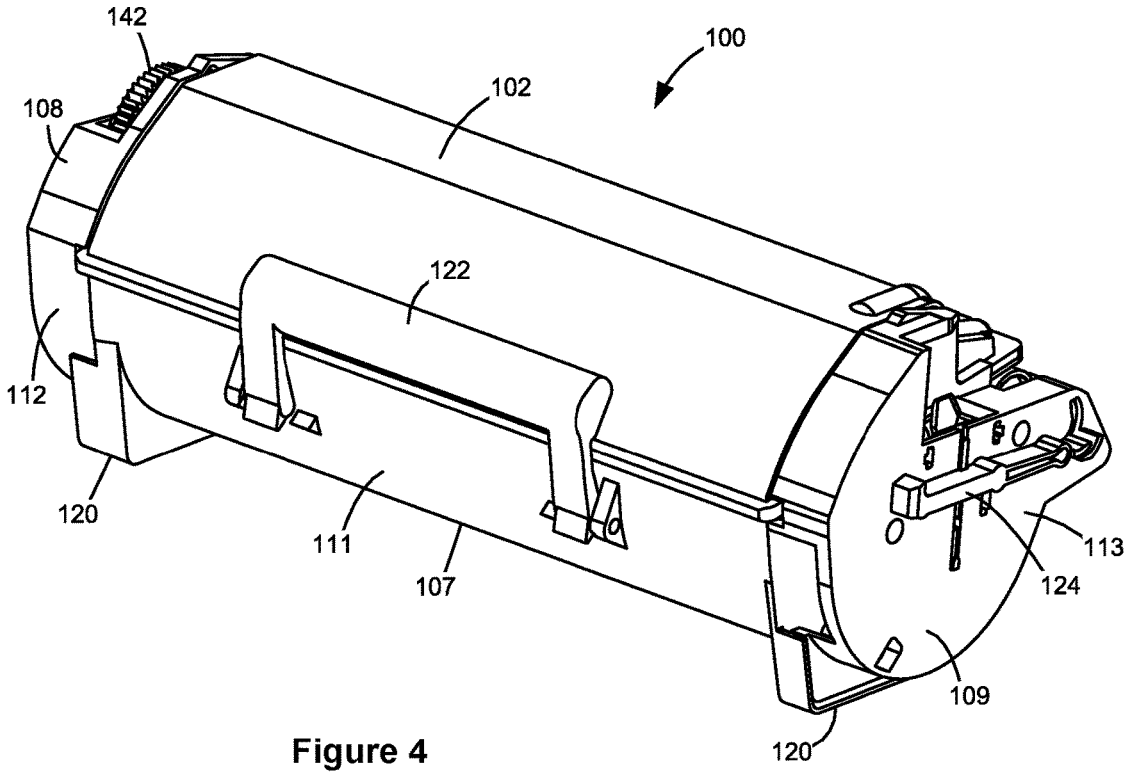
FIG. 4 is a rear perspective view of the toner cartridge shown in FIGS. 2 and 3.

Sides 108, 109 may each include an alignment guide 124 that extends outward from the respective side 108, 109 to assist the insertion of toner cartridge 100 into image forming device 22. Alignment guides 124 travel in corresponding guide slots in image forming device 22 that guide the insertion of toner cartridge 100 into image forming device 22. In the example embodiment illustrated, an alignment guide 124 is positioned on the outer side of each end cap 112, 113. Alignment guides 124 may run along a front-to-rear dimension of housing 102 as shown in FIGS. 2-4.

Figure 5:
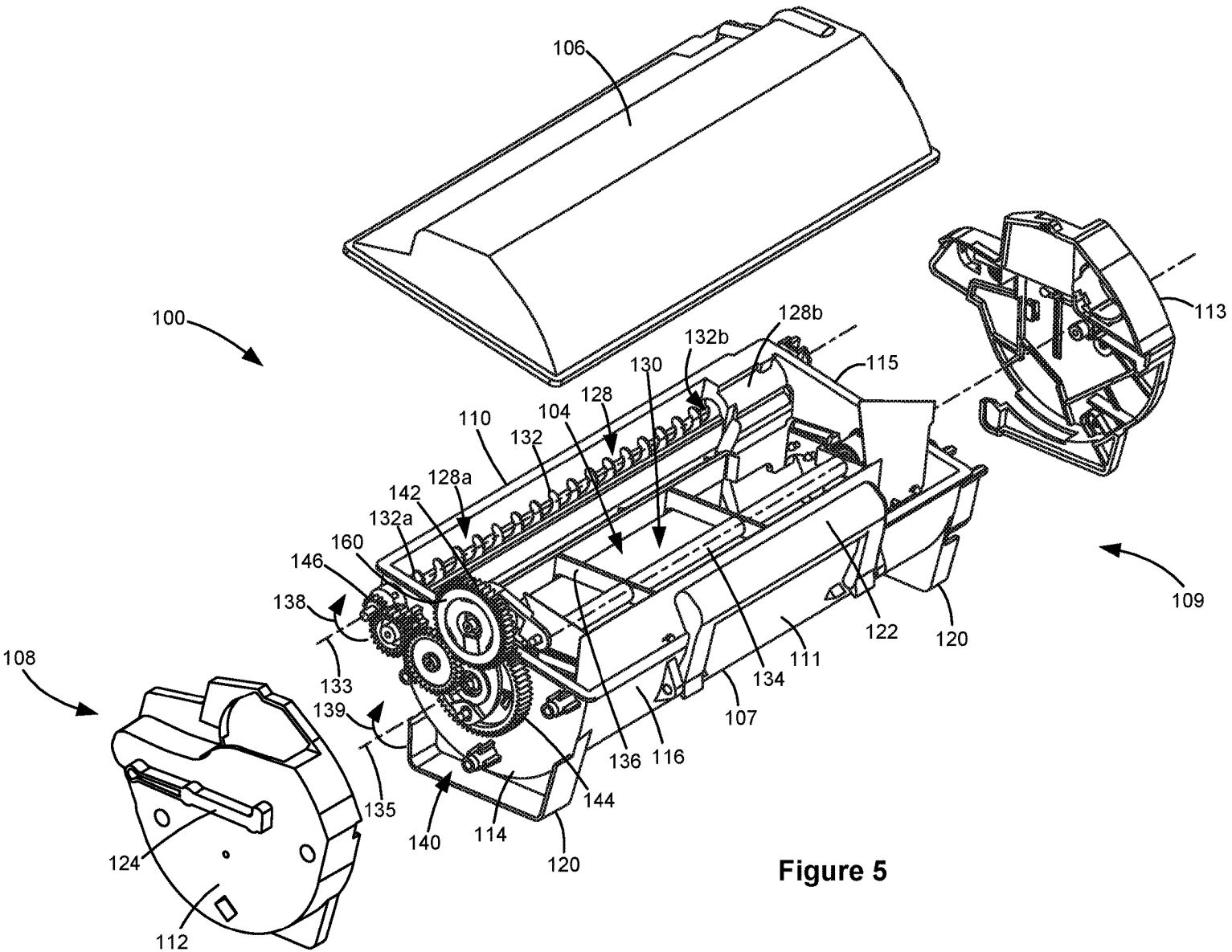
FIG. 5 is an exploded view of the toner cartridge shown in FIGS. 2-4 showing a toner agitator assembly thereof.

With reference to FIG. 5, in the example embodiment illustrated, a toner agitator assembly 130 is rotatably positioned within toner reservoir 104. Toner agitator assembly 130 includes an auger 132 having first and second ends 132*a*, 132*b* and a spiral screw flight. Auger 132 is positioned in a channel 128 that runs along the front 110 of housing 102 from side 108 to side 109. Channel 128 is oriented generally horizontal when toner cartridge 100 is installed in image forming device 22. Auger 132 includes a rotational axis 133. In operation, auger 132 rotates in an operative rotational direction 138. Rotation of auger 132 delivers toner in channel 128 to outlet port 118, which is positioned at the bottom of channel 128 so that gravity assists in exiting toner through outlet port 118. Channel 128 includes an open portion 128*a* and may include an enclosed portion 128*b*. Open portion 128*a* is open to toner reservoir 104 and extends from side 108 toward second end 132*b* of auger 132. Enclosed portion 128*b* of channel 128 extends from side 109 and encloses second end 132*b* of auger 132. In this embodiment, outlet port 118 is positioned at the bottom of enclosed portion 128*b* of channel 128.

Toner agitator assembly 130 also includes a rotatable drive shaft 134 and one or more toner agitators 136 in the form of extensions outward from drive shaft 134. Drive shaft 134 includes a rotational axis 135. In the example embodiment illustrated, rotational axis 135 of drive shaft 134 is parallel to rotational axis 133 of auger 132. In operation, drive shaft 134 rotates in an operative rotational direction 139. Toner agitators 136 rotate with drive shaft 134 around rotational axis 135 when drive shaft 134 rotates in operative rotational direction 139. As drive shaft 134 rotates, toner agitators 136 agitate and mix the toner stored in toner reservoir 104 and, in the embodiment illustrated, move toner toward channel 128 where auger 132 moves the toner to outlet port 118. In the example embodiment illustrated, first and second ends of drive shaft 134 extend through aligned openings in side walls 114, 115, respectively. However, drive shaft 134 may take other positions and orientations as desired. Bushings may be provided on an inner side of each side wall 114, 115 where drive shaft 134 passes through side walls 114, 115.

A drive train 140 on housing 102 is operatively connected to auger 132 and drive shaft 134 and may be positioned within a space formed between end cap 112 and side wall 114. Drive train 140 includes an input gear 142 that engages with a corresponding output gear in image forming device 22 that provides rotational motion from drive motor 70 in image forming device 22 to input gear 142. As shown in FIG. 3, in one embodiment, a front portion of input gear 142 is exposed at the front 110 of housing 102 near the top 106 of housing 102 where input gear 142 engages the output gear in image forming device 22. With reference back to FIG. 5, in the embodiment illustrated, drive train 140 also includes a drive gear 144 on one end of drive shaft 134 that is connected to input gear 142 either directly or via one or more intermediate gears to rotate drive shaft 134. In the embodiment illustrated, drive train 140 also includes a drive gear 146 on first end 132*a* of auger 132 that is connected to input gear 142 either directly or via one or more intermediate gears to rotate auger 132.

Figure 6:
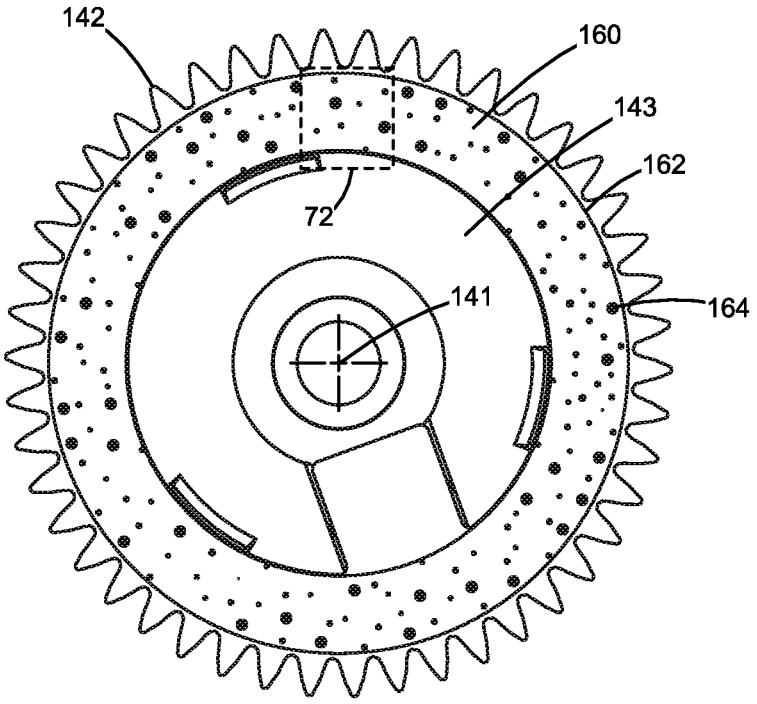
FIG. 6 is a side elevation view of an encoded member of the toner cartridge according to one example embodiment.

With reference to FIGS. 5 and 6, toner cartridge 100 includes an encoded member 160 that is movably connected to drive train 140, either directly or indirectly to input gear 142. In the example embodiment illustrated, encoded member 160 includes a rotatable disk 162 operatively connected to drive train 140, such as, for example, positioned on an outboard face 143 of input gear 142, coaxially with input gear 142 as illustrated. Disk 162 may be formed integrally with input gear 142 or separately attached to input gear 142. In other embodiments, encoded member 160 is, for example, translatable, such as by way of a rack and pinion arrangement or a cam and follower arrangement. Information pertaining to toner cartridge 100 is encoded on encoded member 160. Encoded member 160 is detectable by sensor 72 in image forming device 22 when toner cartridge 100 is installed in image forming device 22 permitting sensor 72 to communicate the encoded information of toner cartridge 100 to controller 28 of image forming device 22 via communications link 57. The encoded information may include, for example, authentication information such as a signature, serial number, or other identifier for authenticating or validating toner cartridge 100 upon installation of toner cartridge 100 in image forming device 22. The encoded information may include, for example, characteristics of toner cartridge 100 such as toner color, initial toner fill amount, toner type, geographic region, manufacture location, manufacture date, etc.

In the example embodiment illustrated, authentication information is encoded on encoded member 160 by randomly distributed magnetized particles 164 dispersed on disk 162, e.g., on the surface of disk 162 and/or within disk 162. Particles 164 are distributed randomly such that it is difficult to reproduce the exact distribution and alignment of particles 164 thereby making the distribution difficult to copy. In this embodiment, sensor 72 is positioned in close proximity to encoded member 62 when toner cartridge 100 is installed in image forming device 22, such as, adjacent to and facing the outboard side of disk 162 as schematically illustrated in FIG. 6. At predetermined times, such as upon the installation of a new toner cartridge in image forming device 22, sensor 72 measures the magnetic field of disk 162 in one, two or three dimensions as disk 162 rotates due to rotation of input gear 142 by motor 70. The magnetic field values measured by sensor 72 are communicated to controller 28 via communications link 57. Controller 28 may then compare the magnetic field values received from sensor 72 to values stored during manufacture in non-volatile memory of processing circuitry 45 of toner cartridge 100. Controller 28 may confirm the authenticity of toner cartridge 100 to controller 28 if the magnetic field values received from sensor 72 match the values stored in non-volatile memory of processing circuitry 45.

While the example embodiment illustrated includes information encoded by a random distribution of magnetized particles and detection by measuring the magnetic field of the particles, it will be appreciated that information may be encoded by a random distribution of non-magnetized particles and detection may occur according to other means, such as, for example, by measuring an optical property of the particles. Further, in lieu of a random pattern, information may be encoded according to a predetermined pattern using any suitable indicia and detection method. However, as discussed above, it is preferred for authentication information to be encoded according to a random pattern so that the encoded information is more difficult for a counterfeiter to reproduce.

With reference back to FIGS. 2 and 3, in the example embodiment illustrated, at least a portion of encoded member 160 is exposed on the exterior of toner cartridge 100 above a rotational axis 141 of input gear 142 for reading by sensor 72. For example, in the embodiment illustrated, encoded member 160 is exposed through a cutout 166 in end cap 112 that is positioned above rotational axis 141 of input gear 142.

Figure 7:
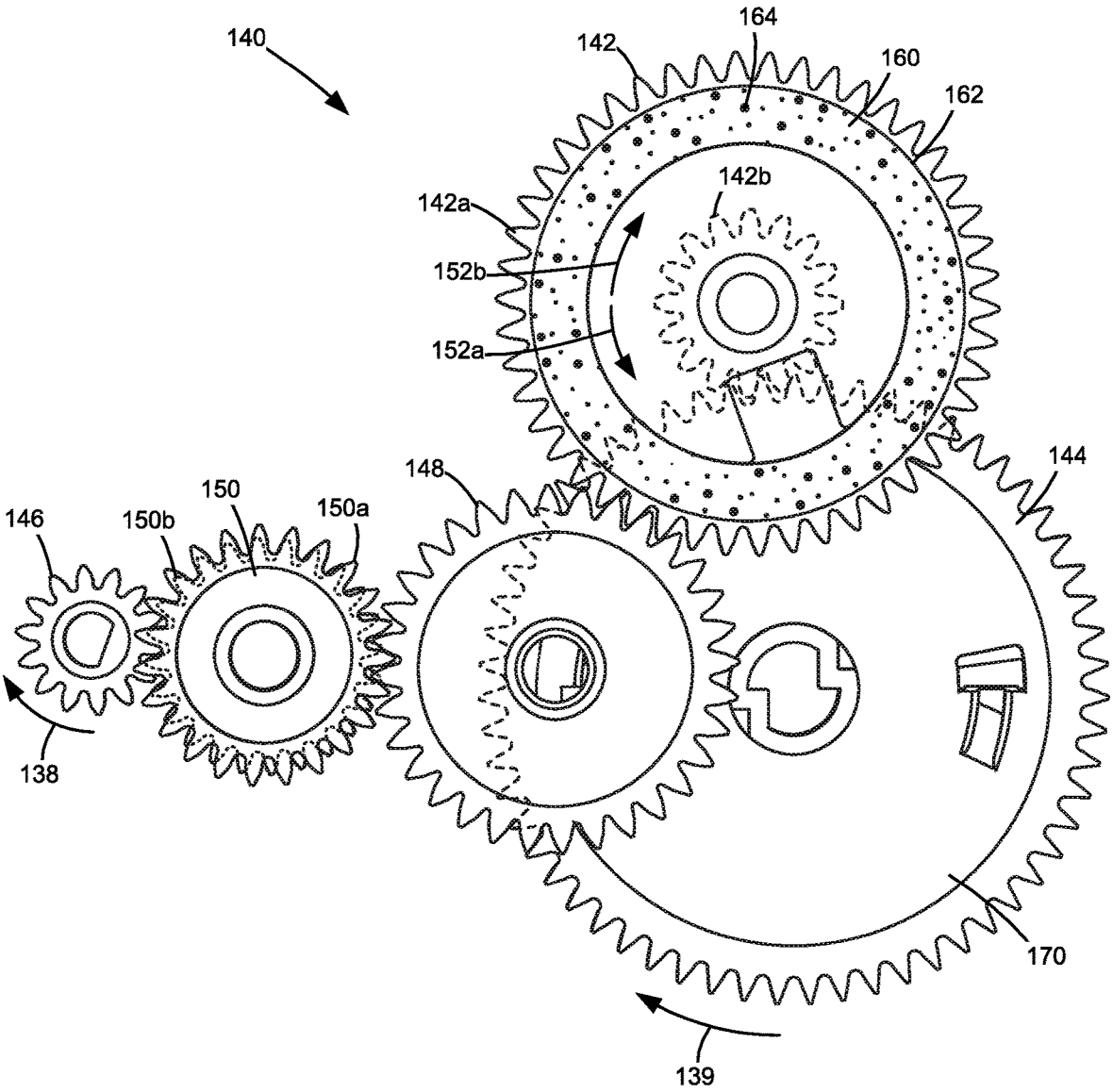
FIG. 7 is a side elevation view of a drive train of the toner cartridge according to one example embodiment.

FIG. 7 shows drive train 140 in greater detail according to one example embodiment. In the example embodiment illustrated, input gear 142 is a compound gear that includes a first portion 142*a* that mates with the corresponding output gear in image forming device 22 when toner cartridge 100 is installed in image forming device 22 and a second portion 142*b* that meshes with drive gear 144 in order to provide rotational motion to drive shaft 134. First portion 142*a* of input gear 142 also meshes with an idler gear 148 that, in turn, meshes with a compound idler gear 150. Compound idler gear 150 includes a first portion 150*a* that meshes with idler gear 148 and a second portion 150*b* that meshes with drive gear 146 in order to provide rotational motion to auger 132. It will be appreciated that the embodiment illustrated in FIG. 7 is merely an example and that drive train 140 may take many suitable configurations for transferring rotational motion from input gear 142 to toner agitator assembly 130 and to encoded member 160.

In operation, controller 28 drives motor 70 in a first rotational direction to drive toner agitator assembly 130 and in a second rotational direction to perform a reading of encoded member 160 by sensor 72. In particular, when controller 28 drives motor 70 in the first rotational direction, input gear 142 rotates in a first rotational direction 152*a* and, in turn, rotates auger 132 and drive shaft 134 in operative rotational directions 138, 139 to feed toner from toner cartridge 100 to developer unit 202. When controller 28 drives motor 70 in the second rotational direction, input gear 142 rotates in a second rotational direction 152*b*. Sensor 72 is configured to read encoded member 160 as input gear 142 rotates in rotational direction 152*b*. In this manner, sensor 72 is able to perform a reading of encoded member 160 separately from a toner feed operation so that the authenticity or validity of toner cartridge 100 may be checked prior to the first use of toner cartridge 100 or at other times when toner cartridge 100 is not in use.

Figure 8:
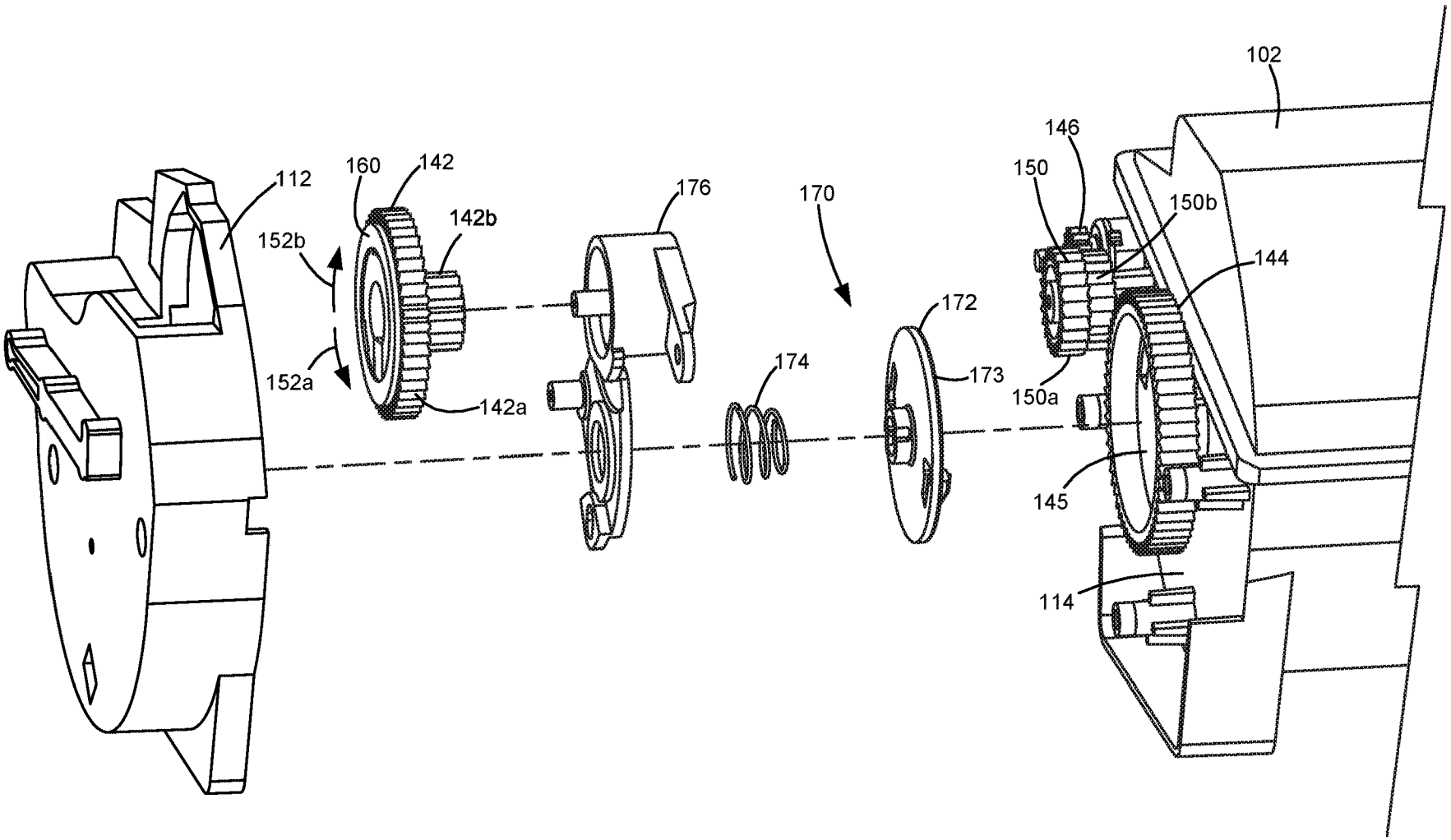
FIG. 8 is an exploded view of the drive train of the toner cartridge showing a one-way clutch according to one example embodiment.

With reference to FIG. 8, toner agitator assembly 130 includes a one-way clutch 170 that limits the rotational motion of at least one component of toner agitator assembly 130 to its operative rotational direction. For example, the one-way clutch may limit auger 132 and/or drive shaft 134 to its operative rotational direction 138, 139. In the example embodiment illustrated, one-way clutch 170 is operatively connected to drive gear 144 such that when input gear 142 rotates in rotational direction 152*a*, drive shaft 134 rotates in operative rotational direction 139 and when input gear 142 rotates in rotational direction 152*b*, drive shaft 134 is decoupled and does not rotate with input gear 142. In this manner, drive shaft 134 and toner agitators 136 do not rotate while sensor 72 performs a reading of encoded member 160. As a result, torque on drive shaft 134 and toner agitators 136 from toner stored in reservoir 104 does not affect the movement of encoded member 160 thereby permitting better control of encoded member 160 while sensor 72 performs a reading of encoded member 160 and improving the accuracy of the reading performed by sensor 72. Further, in some embodiments, toner agitators 136 may include flexible wipers that could displace or become damaged upon rotating counter to operative rotational direction 139. Decoupling drive shaft 134 from input gear 142 when input gear 142 rotates in rotational direction 152*b* prevents this from occurring.

In the example embodiment illustrated, one-way clutch 170 includes a clutch disk 172 positioned against an outboard face 145 of drive gear 144. Clutch disk 172 is biased against outboard face 145 of drive gear 144 by a bias spring 174. A bracket 176 positioned between end cap 112 and side wall 114 locates spring 174 relative to clutch disk 172 and drive gear 144. In the example embodiment illustrated, bracket 176 also locates input gear 142 relative to end cap 112 and to the rest of drive train 140.

Figure 9:
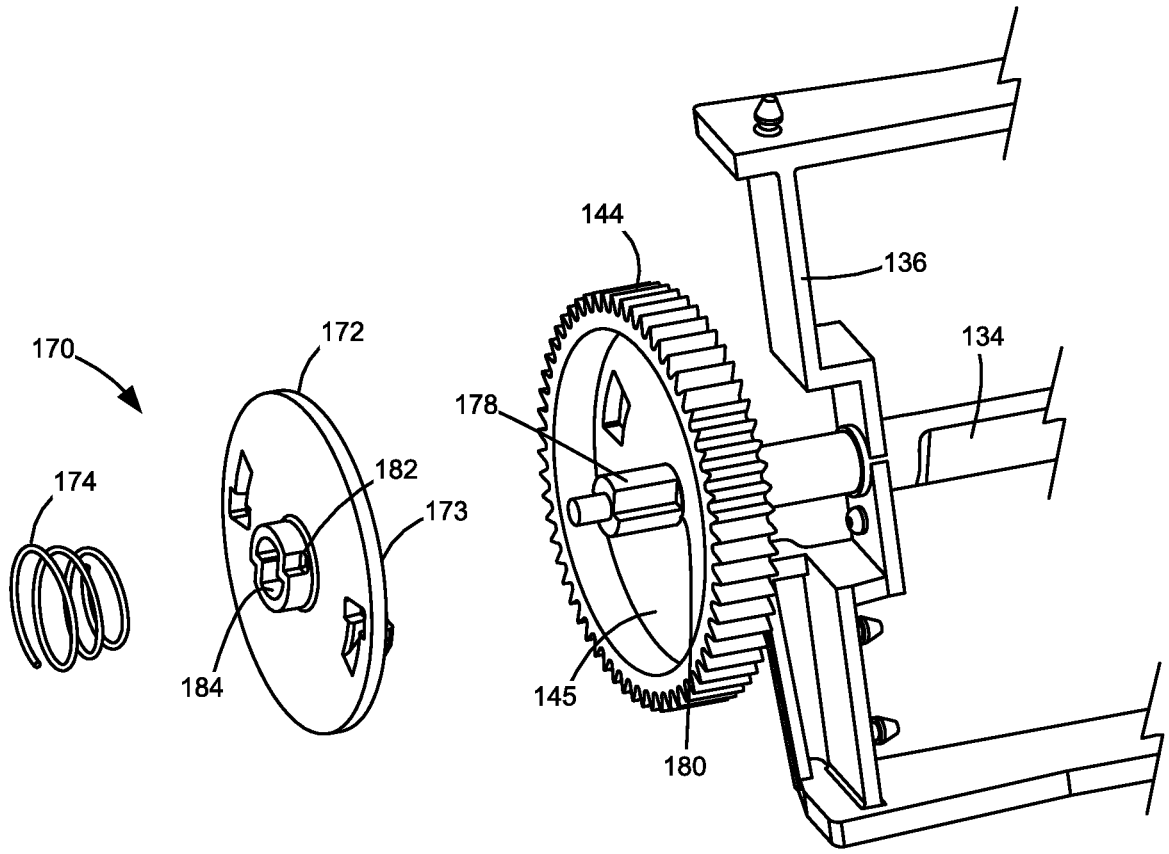
FIG. 9 is an exploded view of the one-way clutch showing the engagement between the one-way clutch and a toner agitator of the toner agitator assembly according to one example embodiment.

With reference to FIG. 9, in the example embodiment illustrated, drive shaft 134 includes a male spline 178 positioned near an axial end of drive shaft 134. Male spline 178 passes through aligned central openings 180, 182 in drive gear 144 and clutch disk 172, respectively. A diameter of central opening 180 of drive gear 144 is larger than male spline 178 of drive shaft 134 permitting drive gear 144 to rotate independent of drive shaft 134. Central opening 182 of clutch disk 172 includes a female spline 184 that matably receives male spline 178 of drive shaft 134 such that drive shaft 134 is rotatably coupled to clutch disk 172.

Figure 10:
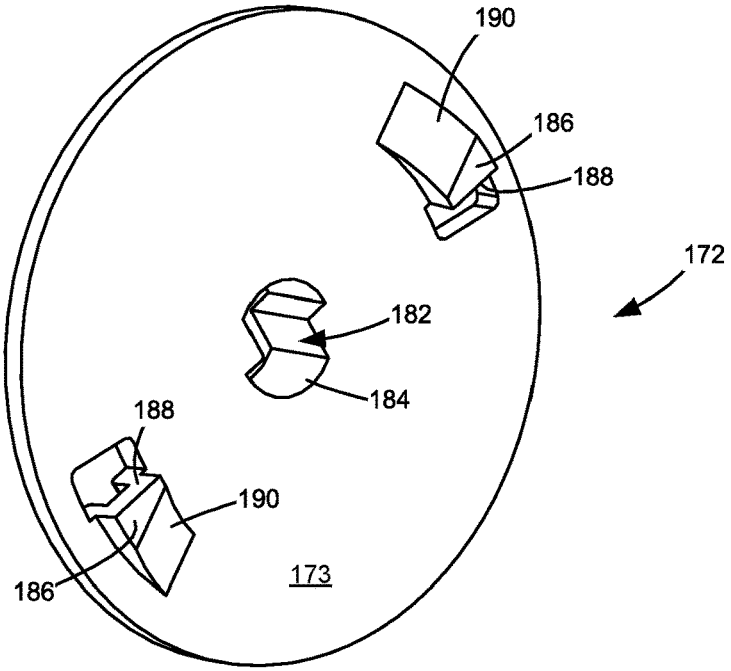
FIG. 10 is a perspective view of a clutch disk of the one-way clutch according to one example embodiment.

With reference to FIG. 10, clutch disk 172 includes one or more engagement members 186 that protrude axially from an inboard face 173 of clutch disk 172 toward outboard face 145 of drive gear 144. Each engagement member 186 includes a contact face 188 positioned to transfer rotational motion from clutch disk 172 to drive gear 144. In the embodiment illustrated, contact faces 188 are positioned perpendicular to inboard face 173 of clutch disk 172; however, contact faces 188 may take other suitable orientations as desired. Each engagement member 186 also includes a ramp 190 on inboard face 173 of clutch disk 172 that tapers axially inward (toward inboard face 173 of clutch disk 172) away from a corresponding contact face 188 of the engagement member 186 along a circumferential dimension of clutch disk 172.

Figure 11:
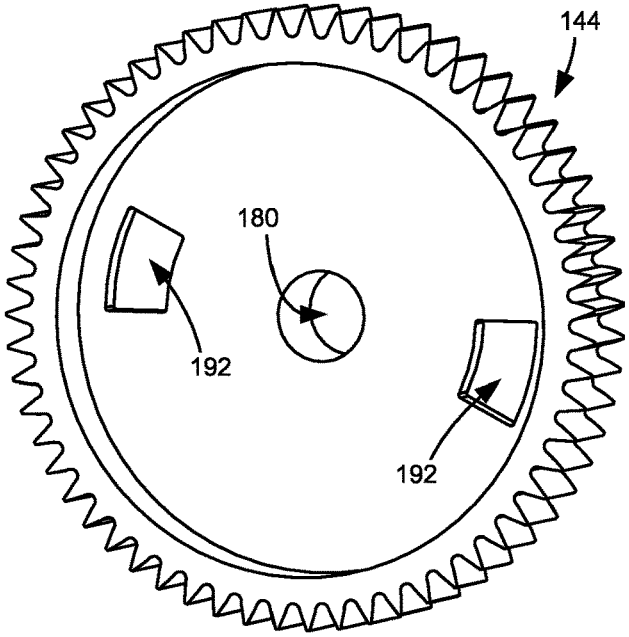
FIG. 11 is a perspective view of a drive gear that engages with the clutch disk according to one example embodiment.

Engagement members 186 of clutch disk 172 are positioned to engage corresponding dwells or openings 192 on drive gear 144 shown in FIG. 11 to transfer rotational motion from drive gear 144 to clutch disk 172 when input gear 142 rotates in rotational direction 152*a*. Specifically, with reference to FIGS. 12 and 13, when input gear 142 rotates in rotational direction 152*a*, drive gear 144 rotates in a first rotational direction 194*a* as a result of the gear mesh between input gear 142 and drive gear 144. As drive gear 144 rotates in rotational direction 194*a*, drive gear 144 rotates independent of clutch disk 172 with engagement members 186 of clutch disk 172 sliding across outboard face 145 of drive gear 144 until engagement members 186 of clutch disk 172 reach openings 192 of drive gear 144. When engagement members 186 of clutch disk 172 reach openings 192 of drive gear 144, clutch disk 172 translates axially toward drive gear 144 and engagement members 186 extend into openings 192 as a result of the bias applied to clutch disk 172 by spring 174. As drive gear 144 continues to rotate in rotational direction 194*a*, the surfaces of drive gear 144 that form openings 192 come into contact with contact faces 188 of engagement members 186 as shown in FIG. 13. The contact between contact faces 188 of engagement members 186 of clutch disk 172 and the surfaces forming openings 192 of drive gear 144 transfer rotational motion from drive gear 144 to clutch disk 172 causing clutch disk 172 to rotate with drive gear 144 as drive gear 144 continues to rotate in rotational direction 194*a*. The engagement between male spline 178 of drive shaft 134 and female spline 184 of clutch disk 172, in turn, causes drive shaft 134 and toner agitators 136 to rotate with clutch disk 172. In this manner, when drive motor 70 rotates in its first rotational direction and input gear 142 rotates in rotational direction 152*a*, drive shaft 134 and toner agitators 136 rotate in operative rotational direction 139 in order to mix the toner in reservoir 104 and to move toner toward auger 132.

Figure 12:
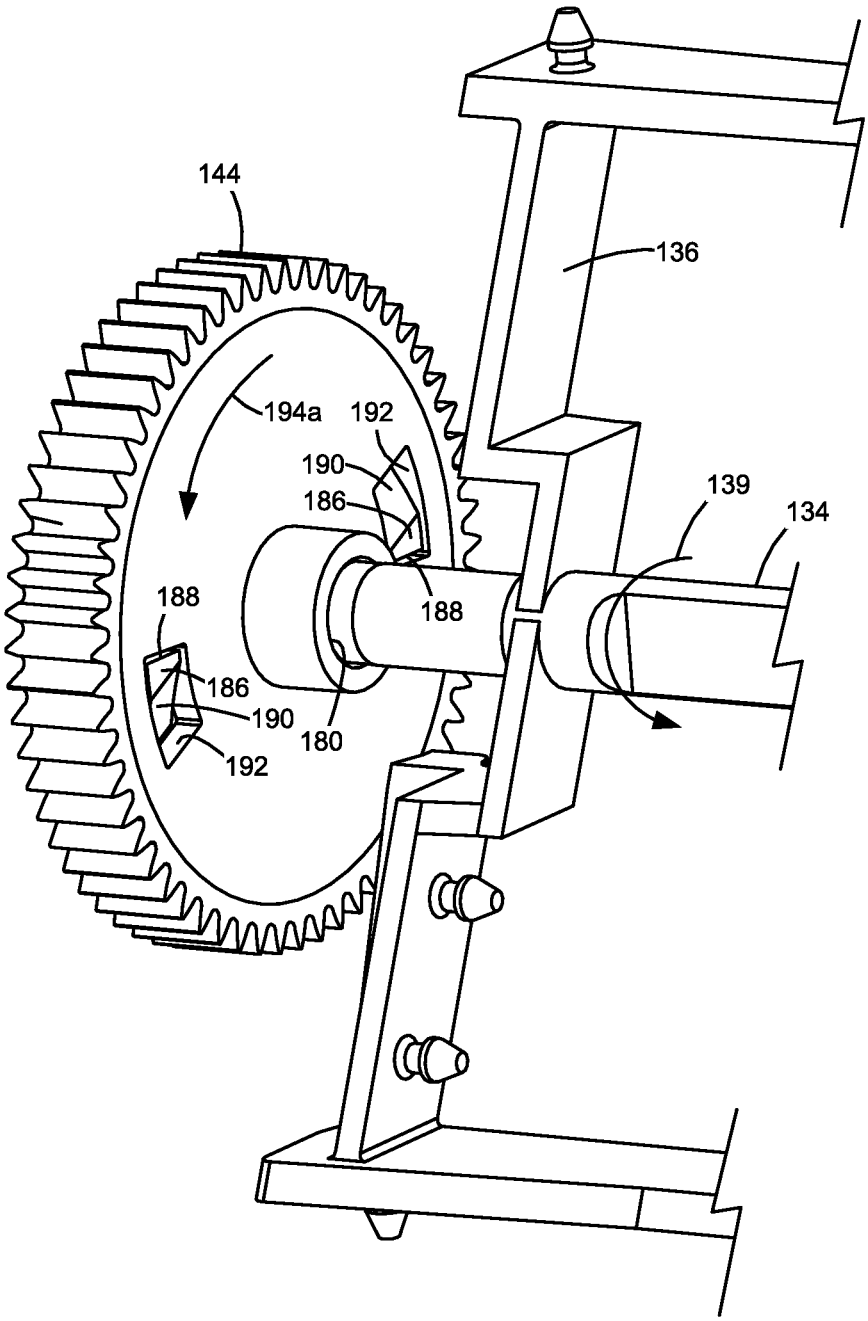
FIG. 12 is a perspective view of the drive gear having the one-way clutch engaged with the toner agitator according to one example embodiment.
Figure 13:
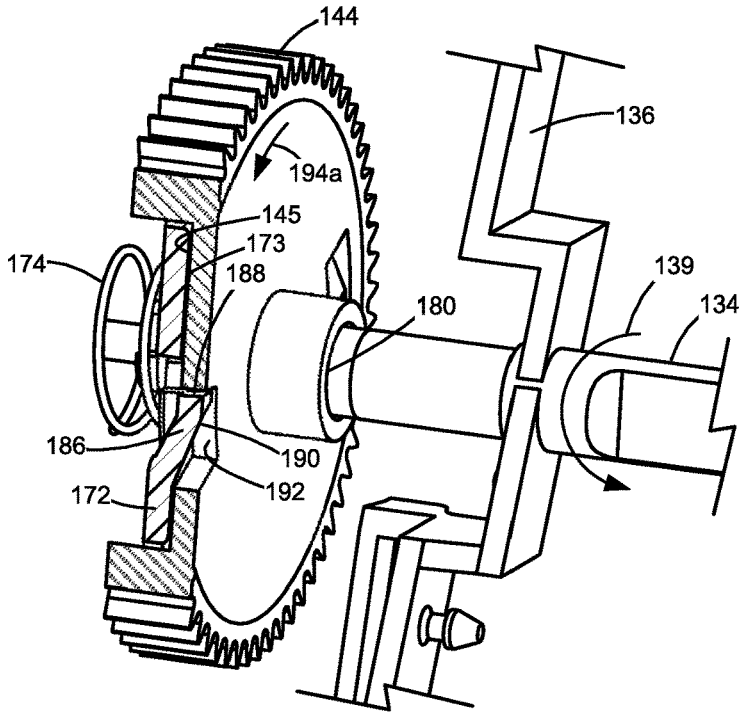
FIG. 13 is a cross-sectional view showing the one-way clutch engaged to rotate the toner agitator when the drive gear rotates in a first direction according to one example embodiment.
Figure 14:
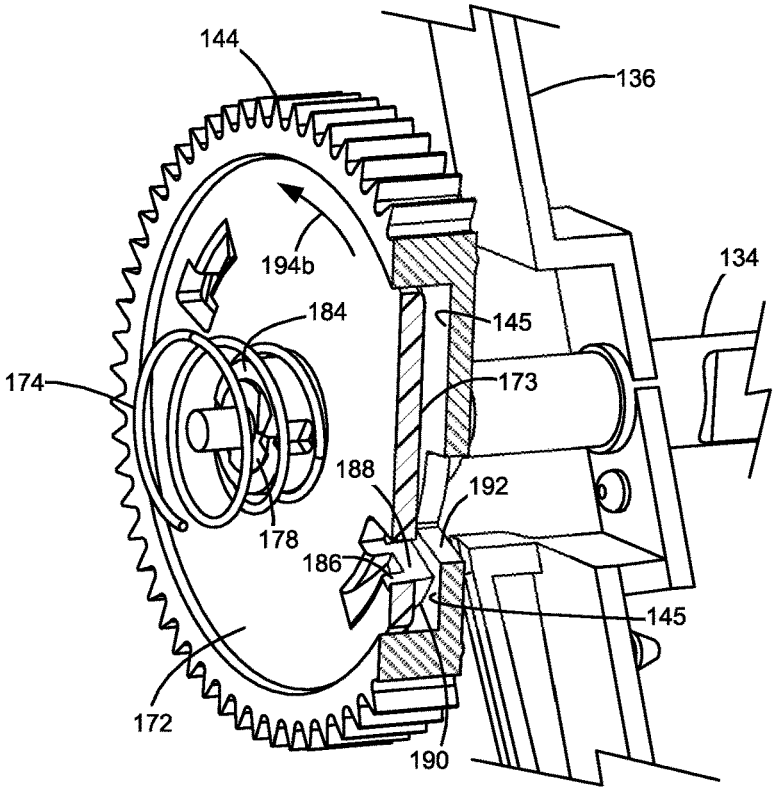
FIG. 14 is a cross-sectional view showing the one-way clutch disengaged such that the toner agitator does not rotate when the drive gear rotates in a second direction according to one example embodiment.

With reference to FIGS. 12 and 14, when input gear 142 rotates in the opposite rotational direction 152*b*, drive gear 144 rotates in a second rotational direction 194*b* as a result of the gear mesh between input gear 142 and drive gear 144. As drive gear 144 rotates in rotational direction 194*b*, drive gear 144 continuously rotates independent of clutch disk 172 such that drive shaft 134 and toner agitators 136 do not rotate with drive gear 144. Specifically, as drive gear 144 rotates in rotational direction 194*b*, engagement members 186 of clutch disk 172 slide across outboard face 145 of drive gear 144 until engagement members 186 of clutch disk 172 reach openings 192 of drive gear 144. When engagement members 186 of clutch disk 172 reach openings 192 of drive gear 144, clutch disk 172 translates axially toward drive gear 144 and engagement members 186 extend into openings 192 as a result of the bias applied to clutch disk 172 by spring 174 as discussed above. However, as drive gear 144 continues to rotate in rotational direction 194*b*, contact between the surfaces of drive gear 144 that form openings 192 and ramps 190 of engagement members 186 cause clutch disk 172 to translate axially away from drive gear 144 against the bias applied to clutch disk 172 by spring 174 thereby causing engagement members 186 of clutch disk 172 to resume sliding across outboard face 145 of drive gear 144 as shown in FIG. 14. In this manner, when drive motor 70 rotates in its second rotational direction and input gear 142 rotates in rotational direction 152*b*, encoded member 160 rotates with input gear 142 for sensing by sensor 72, but drive shaft 134 and toner agitators 136 do not rotate with input gear 142 so that torque on drive shaft 134 and toner agitators 136 from toner stored in reservoir 104 does not interfere with the movement of encoded member 160.

While the example embodiment illustrated in FIGS. 8-14 includes a one-way clutch 170 that includes a clutch disk 172 and bias spring 174, one or more one-way clutches of any suitable construction may be used to limit the rotational motion of at least one component of toner agitator assembly 130 to its operative rotational direction. For example, the one-way clutch may include one or more of a one-way bearing sprag clutch, a trapped roller clutch, a backstop cam clutch, a pawl and ratchet clutch, and a wrap spring clutch.

As discussed above, drive train 140 may take many suitable configurations for transferring rotational motion from input gear 142 to toner agitator assembly 130 and to encoded member 160. Further, while the exampled embodiment illustrated includes a one-way clutch 170 positioned on drive gear 144 connected to drive shaft 134, one or more one-way clutches may be positioned at any suitable point(s) along drive train 140 to limit the rotational motion of at least one component of toner agitator assembly 130 to its operative rotational direction. For example, a first one-way clutch may be positioned to limit the motion of auger 132 to operative rotational direction 138 and a second one-way clutch may be positioned to limit the motion of drive shaft 134 and toner agitators 136 to operative rotational direction 139. Alternatively, a single one-way clutch may be positioned to limit the motion of auger 132 as well as drive shaft 134 and toner agitators 136 to their operative rotational directions 138, 139.

Figure 15:
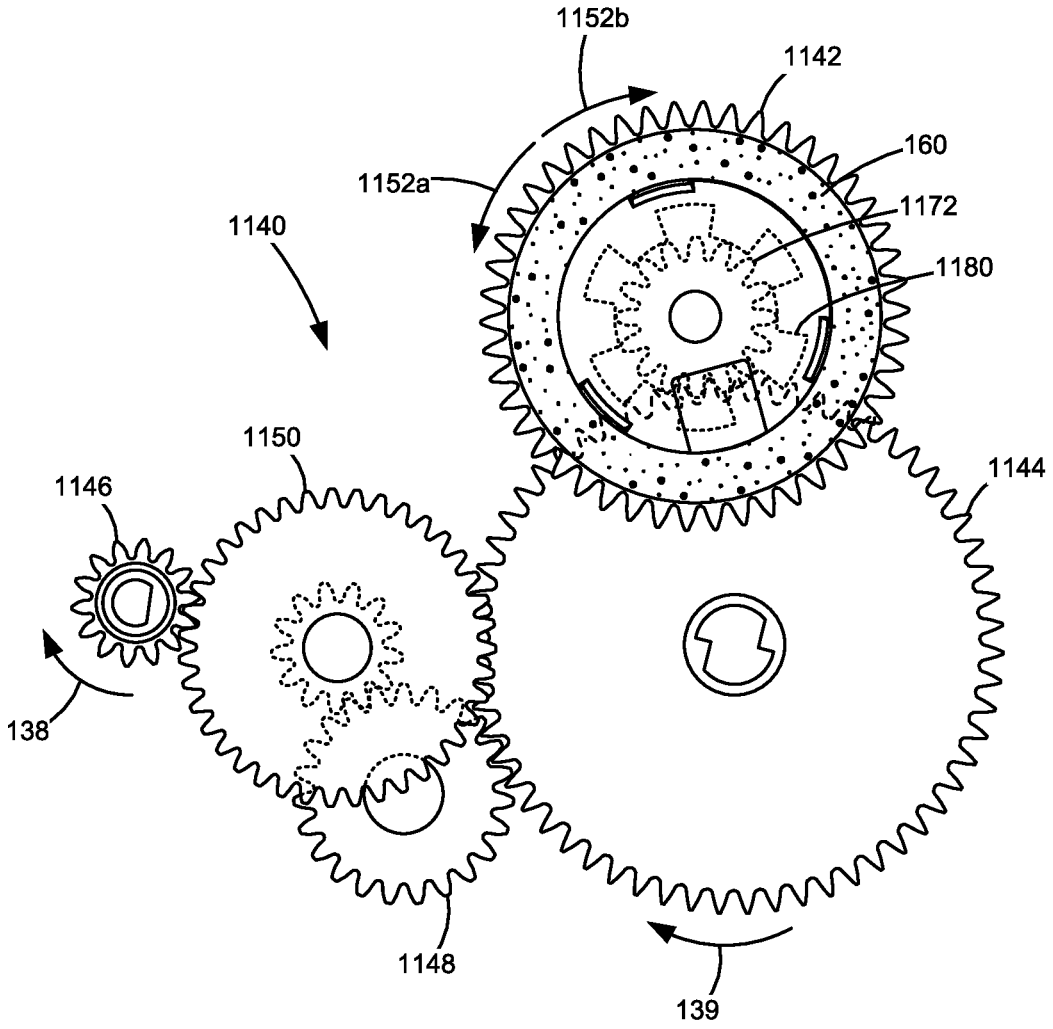
FIG. 15 is a side elevation view of a drive train of the toner cartridge according to a second example embodiment.
Figure 16:
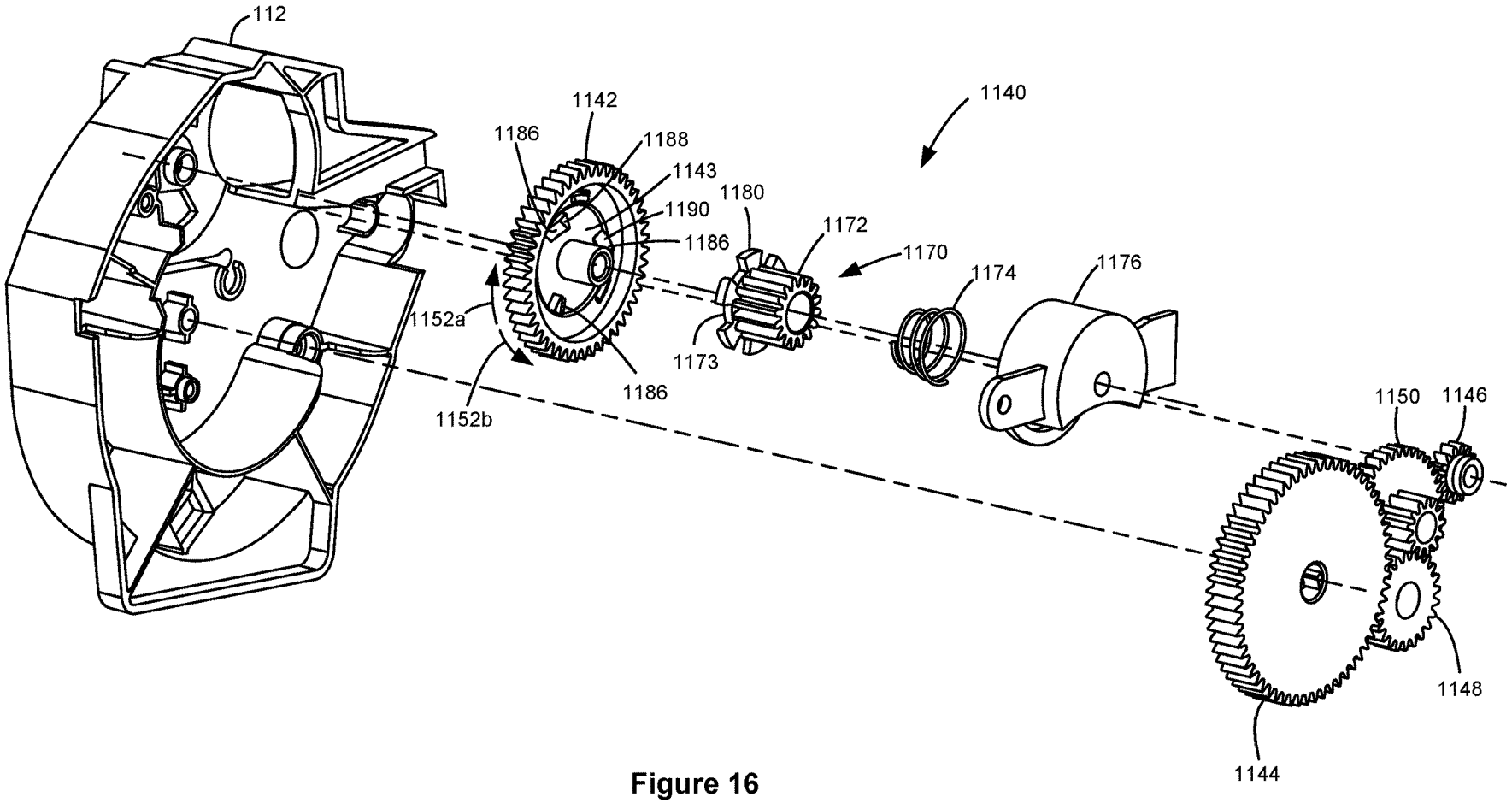
FIG. 16 is an exploded view of the drive train of the toner cartridge shown in FIG. 15.

For example, FIGS. 15 and 16 illustrate a drive train 1140 that includes an input gear 1142 that engages with a corresponding output gear in image forming device 22. Drive train 1140 also includes a drive gear 1144 connected to an end of drive shaft 134 and a drive gear 1146 connected to an end of auger 132. Encoded member 160 is positioned on input gear 1142 as discussed above. In this embodiment, a one-way clutch 1170 is operatively connected to input gear 1142 in order to limit rotation of drive gears 1144 and 1146 to a single direction to limit rotation of auger 132 and drive shaft 134 to their operative rotational directions 138, 139. In this embodiment, one-way clutch 1170 includes a drive gear 1172 biased against an inboard face 1143 of input gear 1142 by a bias spring 1174. A bracket 1176 positioned between end cap 112 and side wall 114 locates spring 1174 relative to drive gear 1172. In this embodiment, drive gear 1172 includes a series of circumferentially spaced, radially extending lugs 1180. In this embodiment, input gear 1142 includes one or more engagement members 1186 that protrude axially from inboard face 1143 of input gear 1142 toward an outboard face 1173 of drive gear 1172. Each engagement member 1186 includes a contact face 1188 positioned to transfer rotational motion from input gear 1142 to drive gear 1172. Each engagement member 1186 also includes a ramp 1190 on inboard face 1143 of input gear 1142 that tapers axially inward (toward inboard face 1143 of input gear 1142) away from a corresponding contact face 1188 of the engagement member 1186 along a circumferential dimension of input gear 1142.

When input gear 1142 rotates in a rotational direction 1152*a*, contact between contact faces 1188 of engagement members 1186 of input gear 1142 and lugs 1180 of drive gear 1172 causes drive gear 1172 to rotate with input gear 1142 as discussed above with respect to engagement members 186 of clutch disk 172 and openings 192 of drive gear 144. Drive gear 1144 connected to drive shaft 134 is meshed with drive gear 1172 such that rotation of drive gear 1172 causes drive gear 1144, drive shaft 134 and toner agitators 136 to rotate with input gear 1142 when input gear 1142 rotates in rotational direction 1152*a*. Drive gear 1146 is connected to drive gear 1144 by way of an idler gear 1148 and a compound idler gear 1150 such that rotation of drive gear 1172 causes drive gear 1146 and auger 132 to rotate with input gear 1142 when input gear 1142 rotates in rotational direction 1152*a*.

When input gear 1142 rotates in an opposite rotational direction 1152*b*, contact between lugs 1180 of drive gear 1172 and ramps 1190 of engagement members 1186 of input gear 1142 cause drive gear 1172 to translate axially away from input gear 1142 against the bias applied to drive gear 1172 by spring 1174 as discussed above with respect to engagement members 186 of clutch disk 172 and openings 192 of drive gear 144. As a result, drive gear 1142 continuously rotates independent of drive gear 1172 such that auger 132, drive shaft 134 and toner agitators 136 do not rotate with input gear 1142 when input gear 1142 rotates in rotational direction 1152*b*.

Figure 17:
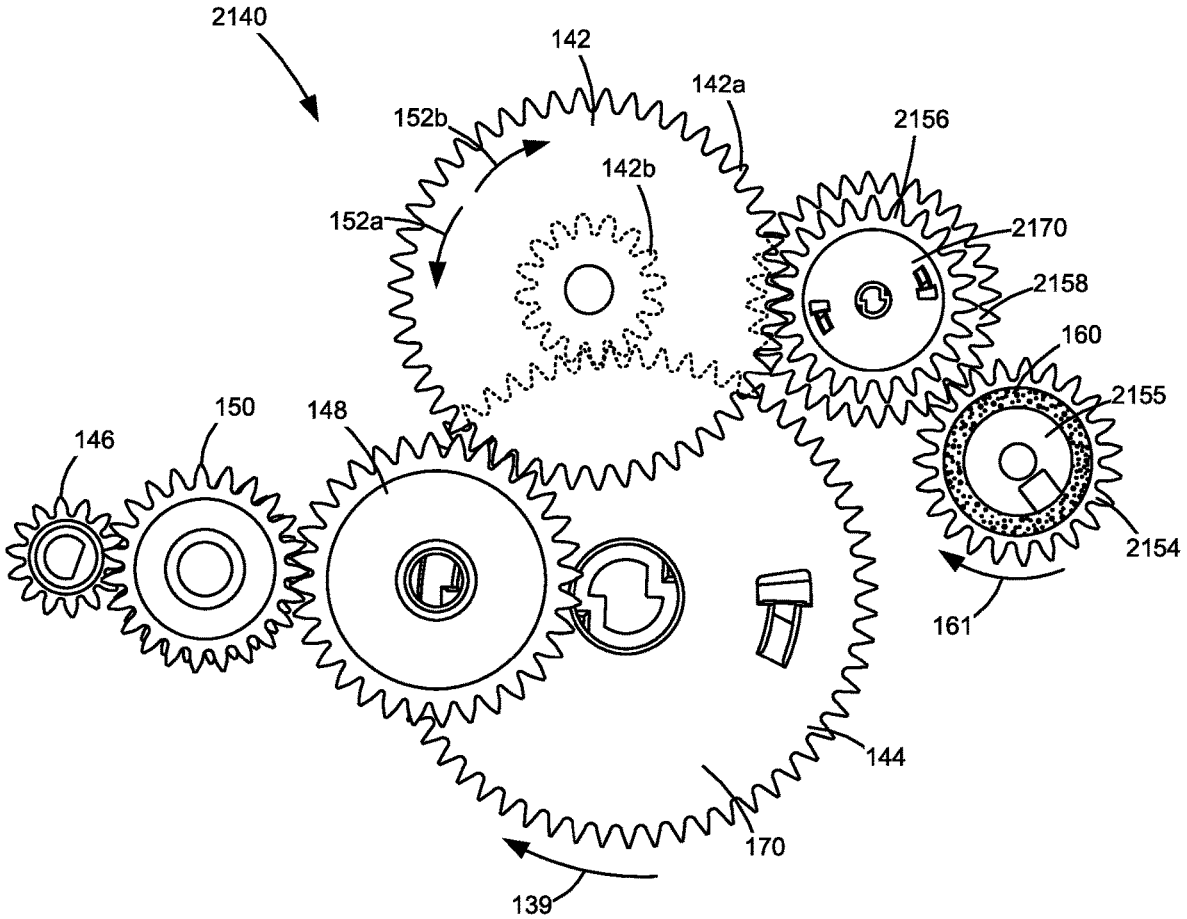
FIG. 17 is a side elevation view of a drive train of the toner cartridge according to a third example embodiment.

While the example embodiments illustrated include a one-way clutch to limit the rotational motion of at least one component of toner agitator assembly 130 to its operative rotational direction, toner cartridge 100 may also include a one-way clutch positioned to limit rotation of encoded member 160 to a single direction as desired for reading by sensor 72. For example, FIG. 17 illustrates encoded member 160 positioned on an outboard face 2155 of a drive gear 2154 that is coupled to input gear 142 by an idler gear 2156 and a drive gear 2158. Drive gear 2154, idler gear 2156 and drive gear 2158 constitute part of a drive train 2140. Drive train 2140 also includes input gear 142 coupled to drive gears 144, 146 by way of idler gears 148, 150 and one-way clutch 170 as discussed above with respect to FIG. 7. Drive train 2140 also includes a one-way clutch 2170 coupled to idler gear 2156 in order to limit rotation of drive gear 2158 to a single direction in the same manner as drive gear 1172 discussed above with respect to FIGS. 15 and 16. In this manner, rotation of drive gear 2154 and encoded member 160 are limited to an operative rotational direction 161 for reading by sensor 72. Specifically, in this embodiment, when drive motor 70 rotates in its first rotational direction and input gear 142 rotates in rotational direction 152*a*, drive shaft 134 and toner agitators 136 rotate in operative rotational direction 139 but encoded member 160 does not rotate with input gear 142. When drive motor 70 rotates in its second rotational direction and input gear 142 rotates in rotational direction 152*b*, encoded member 160 rotates in operative rotational direction 161 but drive shaft 134 and toner agitators 136 do not rotate with input gear 142.

Figure 18:
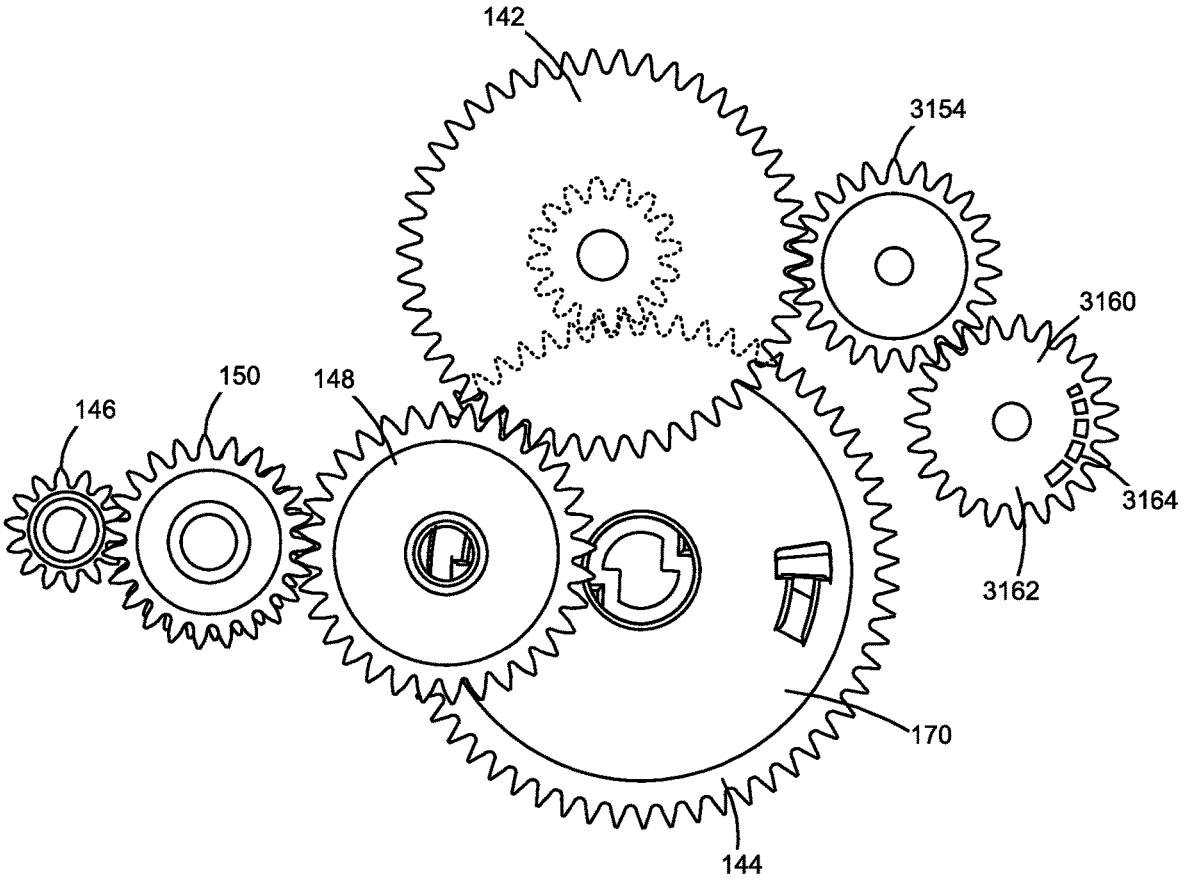
FIG. 18 is a side elevation view of a drive train of the toner cartridge according to a fourth example embodiment.

As discussed above, while the example embodiments illustrated include an encoded member 160 that includes information encoded by a random distribution of magnetized particles, information may be encoded on an encoded member that is movably connected to an input gear of toner cartridge 100 according to many other suitable methods. For example, FIG. 18 illustrates an encoded member 3160 in the form of rotatable disk 3162 that is connected to input gear 142 by a drive gear 3154. Disk 3162 includes a series of cutouts 3164 therethrough that are spaced along a circumferential dimension of disk 3162 according to a predetermined pattern to encode information pertaining to toner cartridge 100. In this embodiment, sensor 72 includes an optical emitter and an optical detector positioned to detect the pattern of cutouts 3164 through disk 3162 as disk 3162 rotates.

While the example embodiments discussed above include a toner agitator assembly 130 that includes a rotatable auger 132 and a rotatable drive shaft 134 having toner agitators 136 extending outward therefrom, it will be appreciated that toner agitator assembly 130 may include any suitable combination of rotating, shifting, reciprocating or otherwise movable toner agitators, which may take many shapes, forms, sizes and orientations. For example, the toner agitator (s) may include any suitable combination of one or more paddles, augers, rakes, combs, scoops, plows, arms, extensions, prongs, flaps, mixers, conveyors, screws, etc.

While the example embodiment shown in FIG. 2 includes a pair of replaceable units in the form of toner cartridge 100 and imaging unit 200, it will be appreciated that the replaceable unit(s) of image forming device 22 may employ any suitable configuration as desired. For example, in one embodiment, the main toner supply for image forming device 22, developer unit 202 and cleaner unit 204 are housed in one replaceable unit. In another embodiment, the main toner supply for image forming device 22 and developer unit 202 are provided in a first replaceable unit and cleaner unit 204 is provided in a second replaceable unit. Further, while the example image forming device 22 discussed above includes one toner cartridge 100 and corresponding imaging unit 200, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow or magenta) and each imaging unit corresponding with one of the toner cartridges to permit color printing. Further, while the example embodiments illustrated pertain to a toner agitator assembly 130 and an encoded member 160 of a toner cartridge 100, it will be appreciated that they may apply to a toner agitator assembly and an encoded member of any toner container including, for example, a developer unit, an imaging unit or a waste toner container.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner container for use in an electrophotographic image forming device, comprising:

a housing having a reservoir for storing toner;

an input gear positioned on the housing for mating with a corresponding output gear in the image forming device when the toner container is installed in the image forming device;

a toner agitator movably positioned in the reservoir, the toner agitator is operatively connected to the input gear such that rotation of the input gear in a first rotational direction causes movement of the toner agitator for agitating toner in the reservoir; and an encoded member encoded with authentication information of the toner container and operatively connected to the input gear such that rotation of the input gear in a second rotational direction causes movement of the encoded member, at least a portion of the encoded member is exposed on an exterior of the toner container for communicating the authentication information of the toner container to a sensor of the image forming device when the toner container is installed in the image forming device.

2. The toner container of claim 1, further comprising a one-way clutch positioned to decouple the toner agitator from the input gear when the input gear rotates in the second rotational direction such that the toner agitator does not move with the input gear when the input gear rotates in the second rotational direction.

3. The toner container of claim 1, wherein the toner agitator includes a shaft rotatably positioned in the reservoir and a plurality of extensions outward from the shaft for agitating toner in the reservoir.

4. The toner container of claim 1, wherein the toner agitator includes a rotatable auger positioned to move toner to an outlet port on the housing for exiting toner from the toner container.

5. The toner container of claim 1, wherein the encoded member is rotatably connected to the input gear such that rotation of the input gear in the second rotational direction causes rotation of the encoded member.

6. The toner container of claim 5, wherein the encoded member is positioned on an axial face of the input gear.

7. The toner container of claim 5, wherein the encoded member is coaxial with the input gear.

8. The toner container of claim 1, wherein the encoded member is directly connected to the input gear.

9. The toner container of claim 1, wherein the encoded member is encoded with authentication information of the toner container by a random distribution of magnetized particles dispersed on the encoded member.

10. The toner container of claim 1, wherein the portion of the encoded member is exposed on the exterior of the toner container above a rotational axis of the input gear.

11. The toner container of claim 1, wherein the portion of the encoded member is exposed on the exterior of the toner container through a cutout in the housing of the toner container.

* * * * *